US012114725B2

(12) United States Patent
Takamasu et al.

(10) Patent No.: US 12,114,725 B2
(45) Date of Patent: Oct. 15, 2024

(54) SHOE INCLUDING AN ELASTIC STRUCTURE

(71) Applicant: ASICS CORPORATION, Kobe (JP)

(72) Inventors: Sho Takamasu, Kobe (JP); Mizuho Irie, Kobe (JP); Shigeyuki Mitsui, Kobe (JP); Kazunaga Nakayama, Kobe (JP); Seigo Nakaya, Kobe (JP); Masanori Sakaguchi, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 17/236,961

(22) Filed: Apr. 21, 2021

(65) Prior Publication Data

US 2021/0330026 A1 Oct. 28, 2021

(30) Foreign Application Priority Data

Apr. 23, 2020 (JP) ..... 2020076951

(51) Int. Cl.
*A43B 13/18* (2006.01)
*A43B 5/06* (2022.01)
*A43B 13/02* (2022.01)

(52) U.S. Cl.
CPC ..... *A43B 13/18* (2013.01); *A43B 13/02* (2013.01); *A43B 13/181* (2013.01); *A43B 5/06* (2013.01)

(58) Field of Classification Search
CPC ..... A43B 13/18; A43B 13/181; A43B 13/183; A43B 13/122; A43B 13/125; A43B 13/02;

(Continued)

(56) References Cited

U.S. PATENT DOCUMENTS 6,457,261 B1 * 10/2002 Crary ..... A43B 13/181 36/137
7,444,767 B2 11/2008 Kilgore et al.
(Continued)

FOREIGN PATENT DOCUMENTS

CN 102438478 A 5/2012
JP 2003189906 A 7/2003
(Continued)

OTHER PUBLICATIONS

Notice of Reasons for Refusal for JP Application No. 2020-568357, dated Dec. 27, 2021, 8 pp. (w/ English Translation) [300.02JP (OA)].

(Continued)

*Primary Examiner* — Khoa D Huynh
*Assistant Examiner* — Haley A Smith
(74) *Attorney, Agent, or Firm* — KONRAD, RAYNES, DAVDA & VICTOR LLP; Alan S. Raynes

(57) ABSTRACT

The present invention provides a shoe having a simpler structure compared to patent document JP-A 2010-162318, with reduced discomfort and enhanced repulsive force. According to an aspect of certain embodiments of the present invention, a shoe 10 comprising: a middle sole 14 having a foot contacting surface 40 and a ground contacting surface 42; an upper at least partially covering the foot contacting surface 40 of the middle sole 14; and an elastic structure 18 curving upwards towards the rear direction at least from the outer foot side of the ground contacting surface is provided. With such configuration, discomfort can be reduced and repulsive force can be enhanced.

20 Claims, 12 Drawing Sheets

(58) Field of Classification Search
CPC ..... A43B 13/143; A43B 13/148; A43B 7/14; A43B 7/141; A43B 7/144; A43B 7/125; A43B 21/32; A43B 21/26; A43B 3/0063; A43B 5/06; A43B 13/37
USPC ..... 36/108, 107
See application file for complete search history.

(56) References Cited

U.S. PATENT DOCUMENTS

| | | | | |
|---|---|---|---|---|
| 7,546,695 | B2 * | 6/2009 | Aveni | A43B 13/181 36/114 |
| 7,954,257 | B2 * | 6/2011 | Banik | A43B 7/1445 36/35 R |
| 7,980,006 | B2 * | 7/2011 | Aveni | A43B 21/36 36/114 |
| 7,997,011 | B2 | 8/2011 | Smith | |
| 8,069,585 | B2 * | 12/2011 | Rohwer-Kahlmann | A43B 21/26 36/35 R |
| 8,387,279 | B2 | 3/2013 | Pauk et al. | |
| 8,397,402 | B2 * | 3/2013 | Lucas | A43B 21/26 36/37 |
| 8,549,773 | B2 | 10/2013 | Nakatsuka | |
| 8,677,656 | B2 * | 3/2014 | Nishiwaki | A43B 7/20 36/69 |
| 10,278,453 | B2 | 5/2019 | Rietdyk | |
| 2007/0022631 | A1 * | 2/2007 | Ho | A43B 13/181 36/29 |
| 2008/0078101 | A1 * | 4/2008 | Smith | A43B 21/26 36/103 |
| 2009/0013556 | A1 | 1/2009 | Nishiwaki et al. | |
| 2009/0113757 | A1 * | 5/2009 | Banik | A43B 13/188 36/35 R |
| 2009/0133290 | A1 * | 5/2009 | Kawai | A43B 13/186 36/114 |
| 2010/0269368 | A1 | 10/2010 | Nakatsuka | |
| 2014/0047740 | A1 | 2/2014 | Tucker | |
| 2014/0115925 | A1 | 5/2014 | Hurd et al. | |
| 2014/0290098 | A1 * | 10/2014 | Loverin | A43B 13/37 36/27 |
| 2016/0324269 | A1 | 11/2016 | Dombrow et al. | |
| 2019/0159547 | A1 | 5/2019 | Nakatsuka | |
| 2019/0343223 | A1 * | 11/2019 | Mason | A43B 13/181 |
| 2019/0387837 | A1 | 12/2019 | Luh | |

FOREIGN PATENT DOCUMENTS

| | | | | |
|---|---|---|---|---|
| JP | 2009514579 | A | 4/2009 | |
| JP | 2010505538 | A | 2/2010 | |
| JP | 2010094480 | A | 4/2010 | |
| JP | 2010162318 | A | 7/2010 | |
| JP | 4704429 | B2 | 6/2011 | |
| JP | 2014008298 | A | 1/2014 | |
| JP | 2015524739 | A | 8/2015 | |
| WO | WO-2009010700 | A2 * | 1/2009 | A43B 13/181 |
| WO | 2018116874 | A1 | 6/2018 | |

OTHER PUBLICATIONS

Chinese Office Action dated Apr. 20, 2022, pp. 6, (w/English translation) for Application No. 202110436120.6 .
European Search Report for EP Application No. 21169628.1, dated Sep. 24, 2021, 7 pp. [300.02EP (EPSR)].
Japanese Office Action dated Nov. 14, 2023, 8 pp (including translation), for Application No. 2020-076951.

* cited by examiner

130

140

150

160

SHOE INCLUDING AN ELASTIC STRUCTURE

TECHNICAL FIELD

The present invention relates to a shoe.

BACKGROUND

Recently, in the field of sport shoes such as running shoes, attention has been paid to a technique for improving the wearer's performance by improving the performance of the shoe. Especially with running shoes, a technique for reducing tiredness of the wearer by improving shock absorption at the time of landing or enhancing force when kicking the ground is desired.

SUMMARY

Patent document JP-A 2010-162318 discloses to attach a leaf spring at the bottom surface of the shoe to absorb shock when landing and to enhance kicking force by the leaf spring.

However, with the shoe disclosed in JP-A 2010-162318, stability when landing is low and since there is a complex shaped leaf spring formed at the bottom, the vibration of leaf spring may give sense of discomfort.

Certain embodiments of the present invention relate to a shoe having a simpler structure compared to document 1, with reduced discomfort and enhanced repulsive force.

In order to solve the aforementioned problem, according to an aspect of certain embodiments of the present invention, a shoe comprising: a sole having a foot contacting surface and a ground contacting surface; an upper at least partially covering the foot contacting surface of said sole; and an elastic structure curving upwards towards the rear direction at least from the outer foot side of said ground contacting surface is provided.

According to such configuration, it is possible to enhance repulsive force with a simple structure and without giving discomfort.

DETAILED DESCRIPTION

The definition of terms used in this document will be explained. In this document, front-back direction, width direction, and vertical direction are used as terms indicating direction. These terms indicate direction seen from a wearer wearing a shoe placed on a flat surface. Therefore, front direction means the toe side and back direction means the heel side. Also, the terms inner foot side and outer foot side are used to indicate direction. Inner foot side means inner side of the foot in the width direction, namely the big toe side and outer foot side means opposite side of the inner foot side in the width direction.

Further, a sole of a shoe will be described. A sole means only a mid-sole or an outer-sole and a mid-sole. In some of the embodiment, 3D rectangular coordinates will be used to indicate directions. In such a case, the X-axis extends from the outer foot side toward the inner foot side, the Y-axis extends from the heel side toward the toe side and the Z-axis extends from the bottom side toward the upper side.

Before explaining the shoe, with reference to FIG. 1, skeleton structure of a foot relating to a shoe will be explained.

Figure 1:
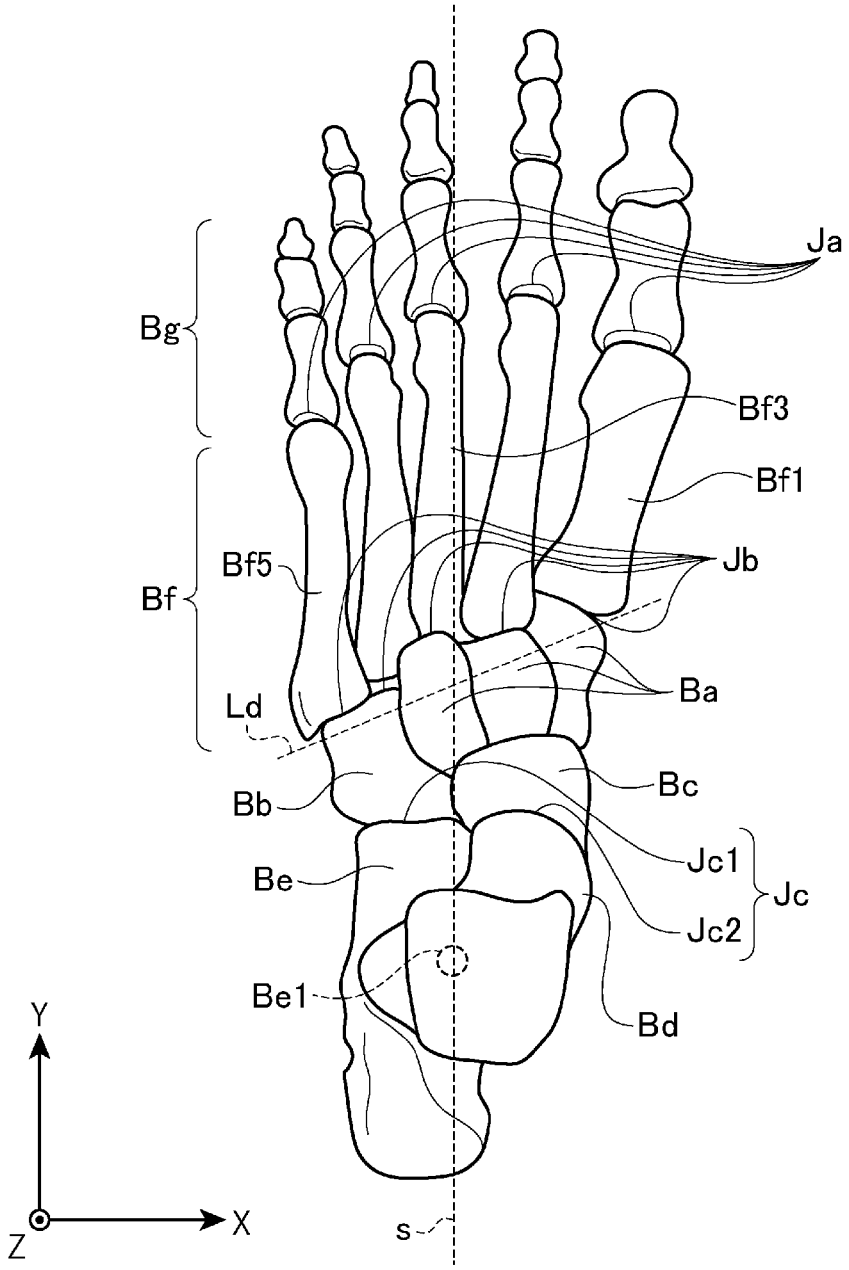
FIG. 1 is a top view a skeleton of a foot.

FIG. 1 shows a top view of skeleton of a foot. A human foot mainly comprises a cuneiform bone Ba, a cuboid bone Bb, a scaphoid bone Bc, an ankle bone Bd, a heel bone Be, a metatarsal bone Bf and phalange Bg. The condition of arthrosis may occur at a MP joint Ja, a Lisfranc joint Jb and a Chopard joint Jc. The Chopard joint Jc includes heel cuboid joint Jc1 formed by the cuboid bone Bb and the heel bone Be and a talonavicular joint Jc2 formed by the scaphoid bone Bc and the ankle bone Bb. In this document, a wearer's "front foot portion" indicates the portion in front relative to the MP joint Ja and when expressed in a length ratio of the shoe, the term indicates approximately 0-30% of the entire length of the shoe measured from the toe side. The term "middle foot portion" indicates the portion in between the MP joint Ja and Chopard joint Jc and expressed similarly, indicates approximately 30-80% of the entire length of the shoe measured from the toe side. The term "rear foot portion" indicates the portion rearward from the Chopard joint Jc and expressed similarly, indicates approximately 80-100% of the entire length of the shoe measured from the toe side. In FIG. 1, center line S indicates the center line of the shoe and extends along the central portion of the width direction. The center line S is assumed to be a straight line which pass through the third metatarsal bone Bf3 and a medial process of calcaneal tuberosity Be1 of the heel bone Be. In FIG. 1, an area is indicated where the medial process of calcaneal tuberosity Be1 is assumed to be located. The ratio relative to the entire length of the shoe is merely a standard and is not intended to limit the area of the front foot portion, the middle foot portion and rear foot portion.

Figure 2:
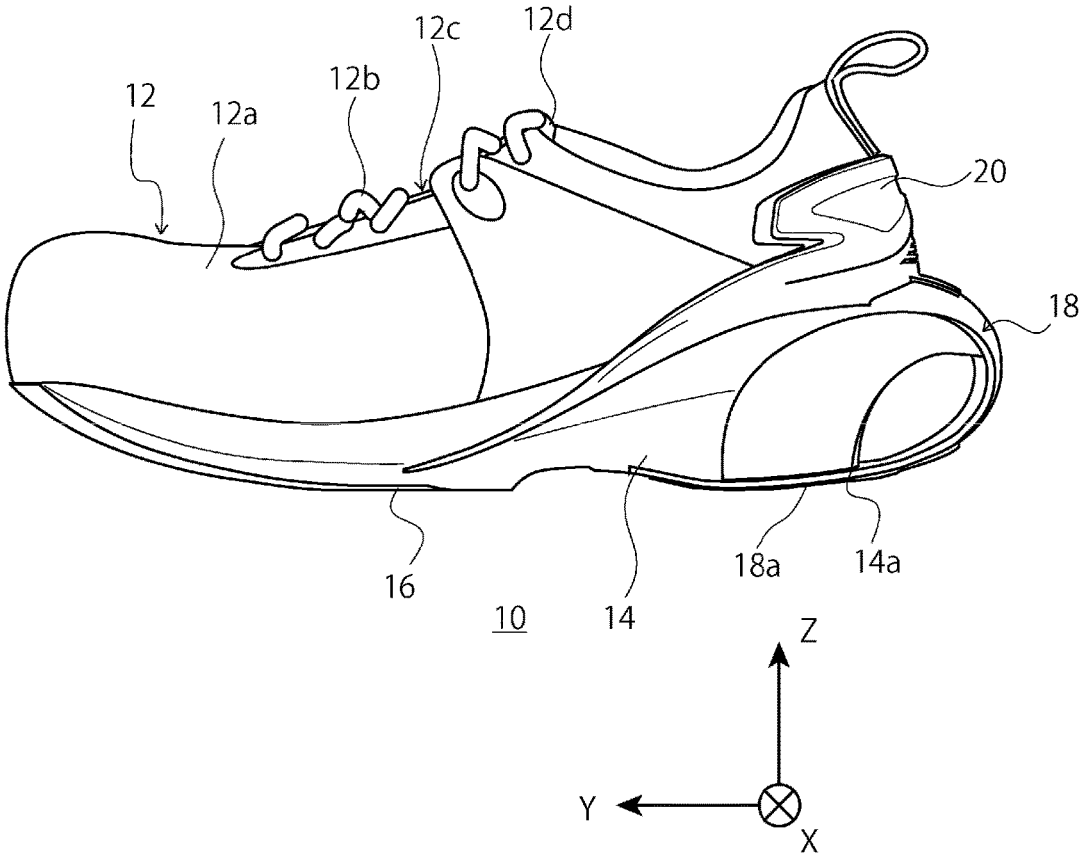
FIG. 2 is a side view of a shoe.
Figure 3:
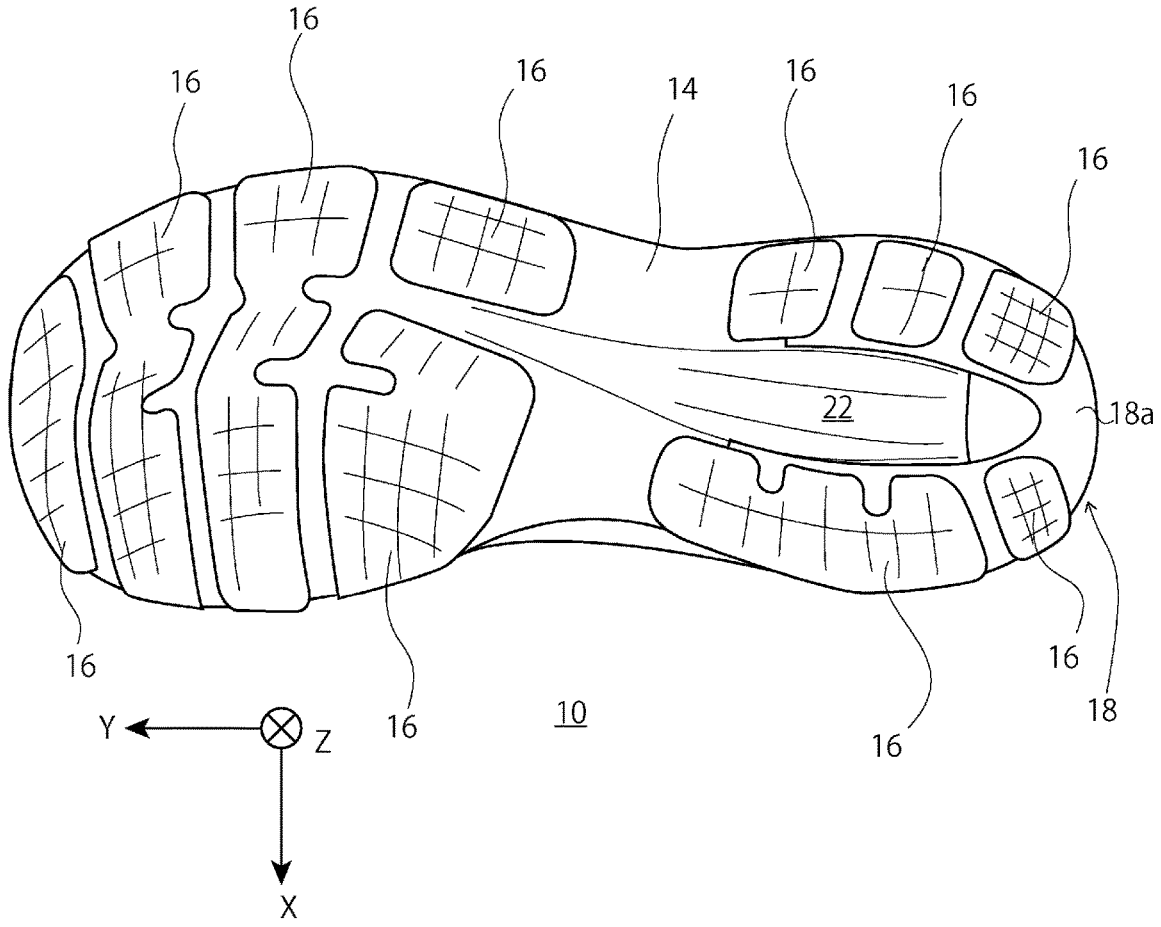
FIG. 3 is a bottom view of a shoe.

FIG. 2 is a side view of a shoe and FIG. 3 is a bottom view of a shoe. As shown in FIGS. 2 and 3, a shoe 10 comprises an upper 12, a middle sole 14, an out sole 16, an elastic structure 18 and a reinforcement member 20.

The upper 12 is shaped to cover the upper side of the instep of the foot. The upper 12 comprises an upper body 12*a*, securing structure 12*b* of the upper 12 and a slit 12*c* extending in a front back direction of the upper 12 at the center of the upper in the width direction. A shoe tongue 12*d* is attached to the upper 12. In this embodiment, as securing structure 12*b* for controlling tightness of the upper 12, a structure comprising an eyelet and a shoelace is disclosed.

However, a hook-and-loop fastener or the like can be used as securing means 12*b*. A mono-sock type upper without a slit may be used.

The upper body 12*a* may be made of meshed material made by knitting synthetic fiber such as polyester or polyurethane, synthetic leather or natural leather and is shaped to cover the instep of the foot. The slit 12*c* is a buffer portion for controlling the width of the upper body 12*a* by tightening the shoelace. On both sides of the slit 12*c*, a plurality of eyelets are formed. The shoe tongue 12*d* is exposed from the slit 12*c* so that the shoelace does not come in contact with the wearer's instep when the shoelace is applied.

The middle sole 14 acts to absorb shock and a portion or the entire part may be formed from a soft material, such as foamed material including foam EVA or foam urethane, GEL or cork which can absorb shock. It is preferable to use material with a Young's modulus that is 10 MPa or less (at 10% distortion), or with material with measured value of 70 by an Asker rubber hardness tester C type.

The reinforcement material 20 is located on the middle sole 14 and the elastic matter 18 is located below the middle sole 14. At the rear foot portion the middle sole 14 is sandwiched from top and bottom by the reinforcement member 20 and the elastic structure 18. On the bottom of the middle sole 14, a groove 22 extending along the Y-axis is formed.

The outer rim of the middle sole 14 has a planar shape imitating the projected shape of the foot seen from the top. The top surface of the middle sole 14 is shaped to correspond to the irregular shape of the underside of the foot. The top surface of the middle sole 14 is joined to the upper 12. More particularly, the upper 12 is joined along the outer rim of the middle sole 14 or along slightly inward of the outer rim of the middle sole 14. For joining the upper 12 to the middle sole 14, stitching the edge of the upper 12 to the middle sole 14 or joining by a binding mechanism such as an adhesive can be applied. The bottom surface of the middle sole 14 is covered by the elastic structure 18 and outer sole 16.

The outer sole 16 may be formed by molding a plurality of rubber materials into a certain shape. The outer sole 16 may be pasted to the bottom surface of the middle sole 14 so that the outer sole 16 at least partially covers the bottom surface of the middle sole 14. As will be described hereinafter, the elastic structure 18 may have a forked shape and a part of the outer sole 16 may be pasted to the outer surface 18*a* of the elastic structure 18.

Figure 4:
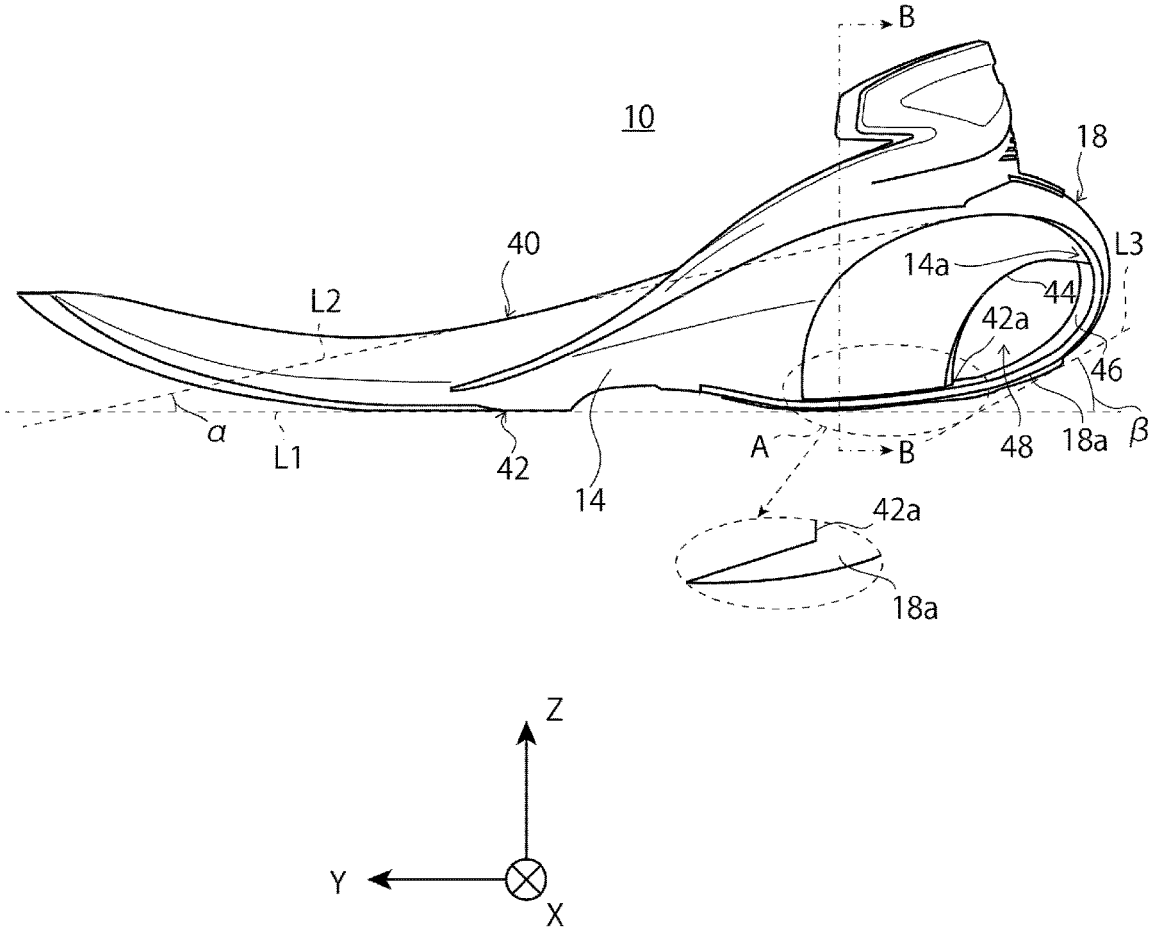
FIG. 4 is a side view of a shoe.
Figure 5:
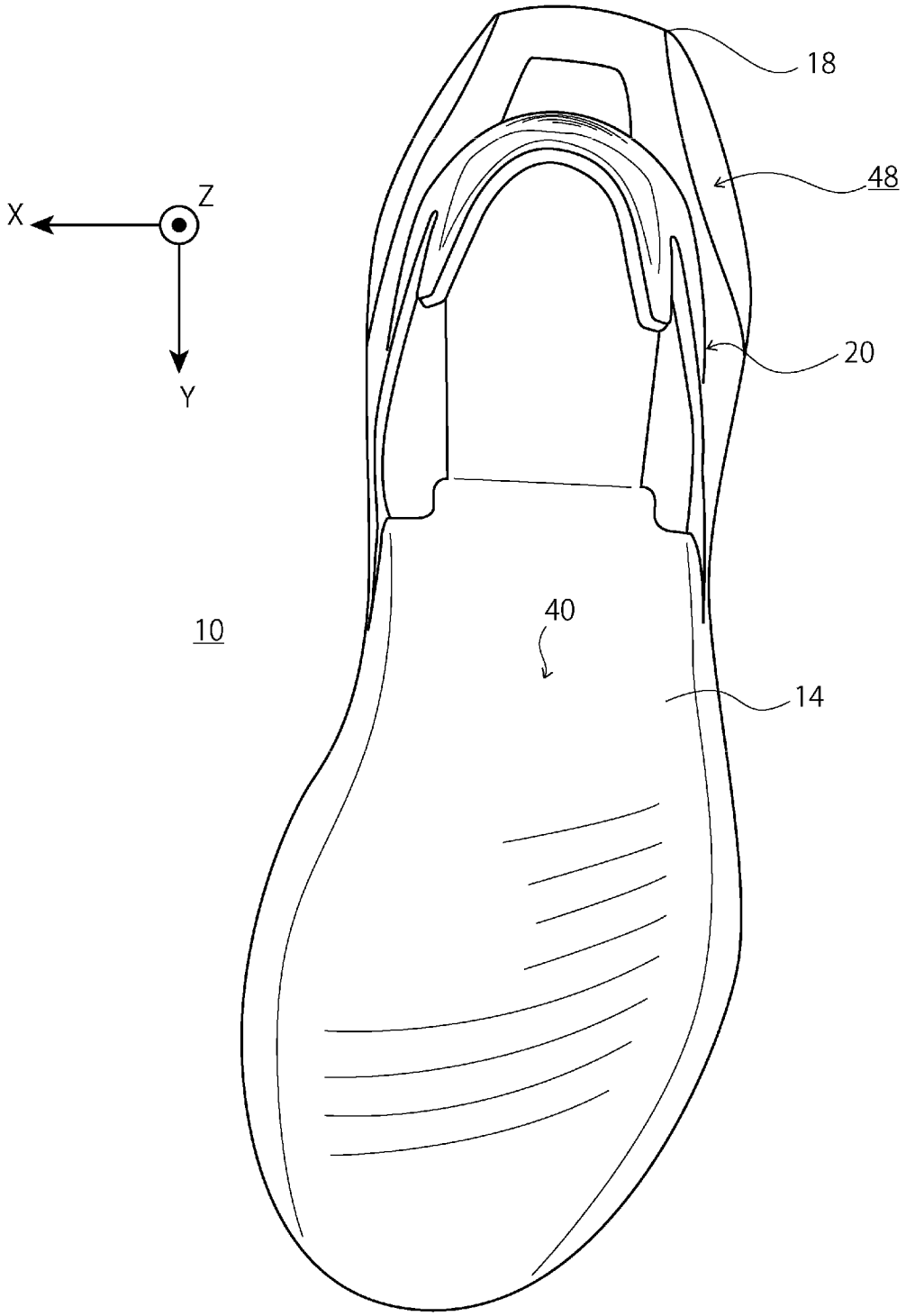
FIG. 5 is a top view of a shoe.

FIG. 4 shows a side view of a shoe wherein the figure shows a condition where the upper is removed. FIG. 5 shows a top view of a shoe and wherein the figure shows a condition where the upper is removed.

As mentioned above, the reinforcement member 20 is located on the upper surface (namely, the foot contacting surface) 40 of the middle sole. The foot contacting surface 40 includes a surface in which directly contacts the wearers foot and a surface which indirectly contacts the wearers foot via a middle member such as an inner sole. In other words, the foot contacting surface 40 indicates the entire top surface of the middle sole 14 where the wearer's weight is applied. Also, since the elastic structure 18 extends from the ground contacting surface 42 to the foot contacting surface 40, the middle sole 14 can be interpreted that it is vertically sandwiched by the elastic structure 18. The rear end 42*a* of the ground contacting surface 42 may be located directly beneath the rear end of the wearers foot or in front of thereof. The rear end surface 44 of the middle sole 14 extends between the rear end 42*a* of the ground contacting surface 42 and the rear end 14*a* of the middle sole 14. The rear end 44 of the middle sole 14 has an upwardly and forwardly curved shape seen in a side view. The area surrounded by a dotted line A in FIG. 4, shows a top view near the rear end of the ground contacting surface 42. As shown in the area surrounded be the dotted line A, the ground contacting surface 42 of the middle sole 14 has a shape tapered toward the rear side at the rear foot portion. In other words, in the vicinity of the rear end of the ground contacting surface 42, the outer rim of the ground contacting surface 42 is tilted toward the center side at both sides in the width direction. Thereby, a portion of the inner surface 46 of the elastic member is exposed upwardly. Thereby, the vicinity of the rear end of the middle sole has a tapered shape at both sides in the width direction. In other words, both sides of the middle sole 14 in the width direction may be cut-out. By tapering the vicinity of the rear end of the middle sole 14, the middle sole 14 can easily be deformed when compressed and the cushioning is improved.

Space 48 may be formed between the rear end surface 44 of the middle sole and the inner surface (U-shaped inner surface) of the elastic structure 18. The space 48 is defined by the rear end surface 44 and the inner surface 46 of the elastic structure 18 and penetrates the shoe 10 in the width direction. The space 48 acts as a space for deforming the elastic structure 18 when the elastic structure is compressed in a vertical direction.

A portion of the foot contacting surface 40 may be tilted relative to the horizontal surface (XY surface) L1 so that the wearers heel is kept higher than the wearers toe. In FIG. 4, an imaginary line L2 connects a portion corresponding to the heel center foot in the foot contacting surface 40 and the lowest portion in of the foot contacting surface 40 in the middle foot portion. In such a case, it is preferred that the acute angle $\alpha$ between the horizontal surface L1 and the imaginary line L2 is 4 to 16 degrees. More preferably, the acute angle $\alpha$ is 8 to 16 degrees.

The elastic structure 18 may have a U-shape protruding rearwards seen from the side. The cross section of the elastic structure 18 in a vertically middle portion may have a U-shaped profile protruding rearwards in a top view. The elastic structure 18 may be made of thermoplastic polyurethane such as polyurethane resin or plastic material such as fiber reinforced plastic having a greater Young's modulus compared to the middle sole 14. It is preferable that the elastic structure 18 is made of material having Young's modulus greater than 100 MPa.

One end of the elastic structure 18 partially covers the foot contacting surface 40 of the middle sole 14 and extends from the rear foot portion to the middle foot portion. The other end of the elastic structure 18 extends proximate to the foot contacting surface 40 of the middle sole 14. In other words, the elastic member 18 has a loop shape where the elastic member 18 once extends rearward from the ground contacting surface 42 and returns toward the foot contacting surface 40 via an inflection point.

The outer surface 18*a* of the elastic structure 18 may have a continuously curved surface when seen from the side. The acute angle $\beta$ formed by the tangent L3 at the most rear end of the outer sole 16 is preferably 20 to 30 degrees. The acute angle $\beta$ can be an angle between the tangent of the outer sole 16 and the horizontal surface L1.

Figure 6:
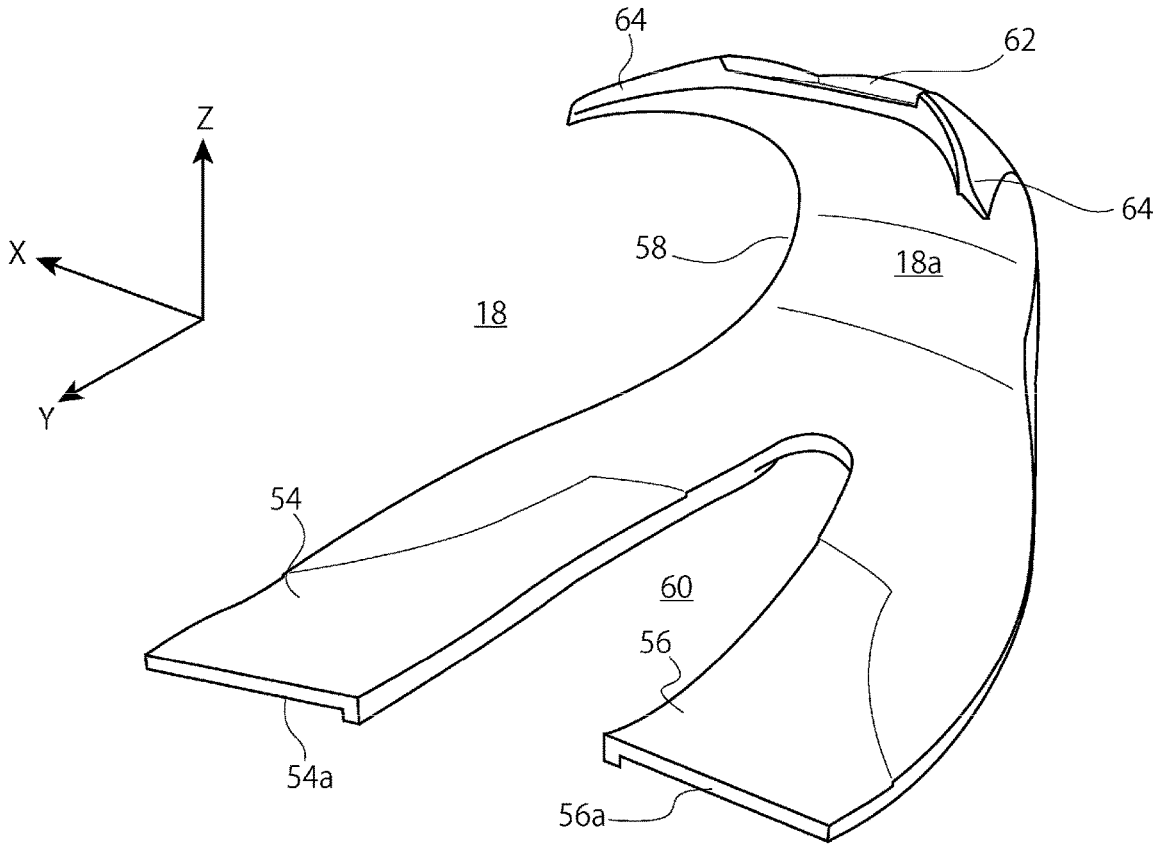
FIG. 6 is a perspective view of an elastic structure of a shoe.

FIG. 6 shows a perspective view of the elastic structure. As shown in FIG. 6, the elastic structure 18 has a shape where substantially Y-shape plate is curved. One end of the elastic structure 18 has a forked shape and each of the ends form either an inner foot side portion 54 and an outer foot side portion 56. The inner foot side portion 54 extends along the inner foot side of the ground contacting surface 42. The outer foot side portion 56 extends along the outer foot side of the ground contacting surface 42. The outer rim of the inner foot side portion 54 and the outer foot side portion 56 is shaped to imitate the shape of the ground contacting surface 42. Space 60 is formed in between the inner foot side portion 54 and the outer foot side portion 56. The space 60 is adapted to the position of the groove 22 of the middle sole and the groove 22 is exposed from the space 60. The front ends 54*a*, 56*a* of the inner foot side portion 54 and the outer foot side portion 56 extends to the middle foot portion. The front end 54*a* of the inner foot side portion 54 is located in front of the front end 56*a* of the outer foot portion 56. In other words, the inner foot side portion 54 covers a longer area of the ground contacting surface 42 in the front-back direction. By this, the stiffness of the inner foot side of the ground contacting surface 42 can be enhanced to prevent pronation. The location where the inner foot side portion 54 and the outer foot side portion 56 is connected is on the rear side of the rear end 42*a* of the ground contacting surface and is within the space 48 (see FIG. 4). In other words, the space 60 is continuous with the space 48.

By introducing a forked inner foot side portion 54 and the outer foot side portion 56, the inner foot side portion 54 and the outer foot side portion 56 can deform independently. By this, the inner foot side portion 54 and the outer foot side portion 56 can deform independently in response to the weight applied thereon. Also, by positioning the connecting point of the inner foot side portion 54 and the outer foot side portion 56 on the rear side of the rear end 42*a* of the ground contacting surface 42, independency of the deformation can be enhanced.

With reference to FIG. 3, the outer sole 16 may be pasted on the outer surface of the inner side portion 54 and the outer side portion 56. Although the pasting location of the outer sole 16 is not limited, it is preferable to paste the outer sole 16 on the boundary of the front end 54*a* of the inner foot side portion 54 and the middle sole 14, and on the boundary of the front end 56*a* of the outer foot side portion 56 and the middle sole 14. Thereby, the front ends 54*a*, 56*a* do not directly contact the ground and prevent the elastic structure 18 from coming off. More preferably, the outer sole 16 is formed on the rear side of the rear end 42*a* of the ground contacting surface 42. As will be described herein after, this is because the rear end comes in contact with the ground before the rear end 42*a* of the ground contacting surface 42. In such a case, it is preferable to locate the outer sole 16 so that the wearer can land starting from the outer sole 16 even when the landing occurs at an angle of 30 degrees relative to the ground contacting surface 42 with the toe facing upwards.

The elastic structure 18 comprises a rising portion 58 rising from the location where the inner foot side portion 54 and the outer foot side portion 56 is connected, toward the upper side. The rising portion 58 may have a rearwardly protruding curved shape in both the XY plane and the YZ plane. By curving the rising portion 58 in the XY plane, stiffness against the load in the vertical direction can be enhanced. Also, by curving the rising portion 58 in the YZ plane, the spring constant of the elastic structure 18 can be enhanced to provide elasticity. The vicinity of the upper end of the rising portion 58 (namely, the other end of the elastic structure 18), contacts the upper surface of the middle sole 14 and is supported by the middle sole from the lower side. A concave portion 62 for engaging with the reinforcement member 20 is formed on the vicinity of the upper end of the rising portion 58. The concave portion 62 is a recess formed on the upper surface side of the other end of the elastic structure 18.

A pair of protrusions 64 protruding forwardly are formed on both sides, in the width direction, of the concave portion 62 of the elastic member 18. The middle sole 14 is pinched from the width direction by the pair of protrusions 62 so that the elastic structure 18 does not shift in the width direction relative to the middle sole 14.

Figure 7:
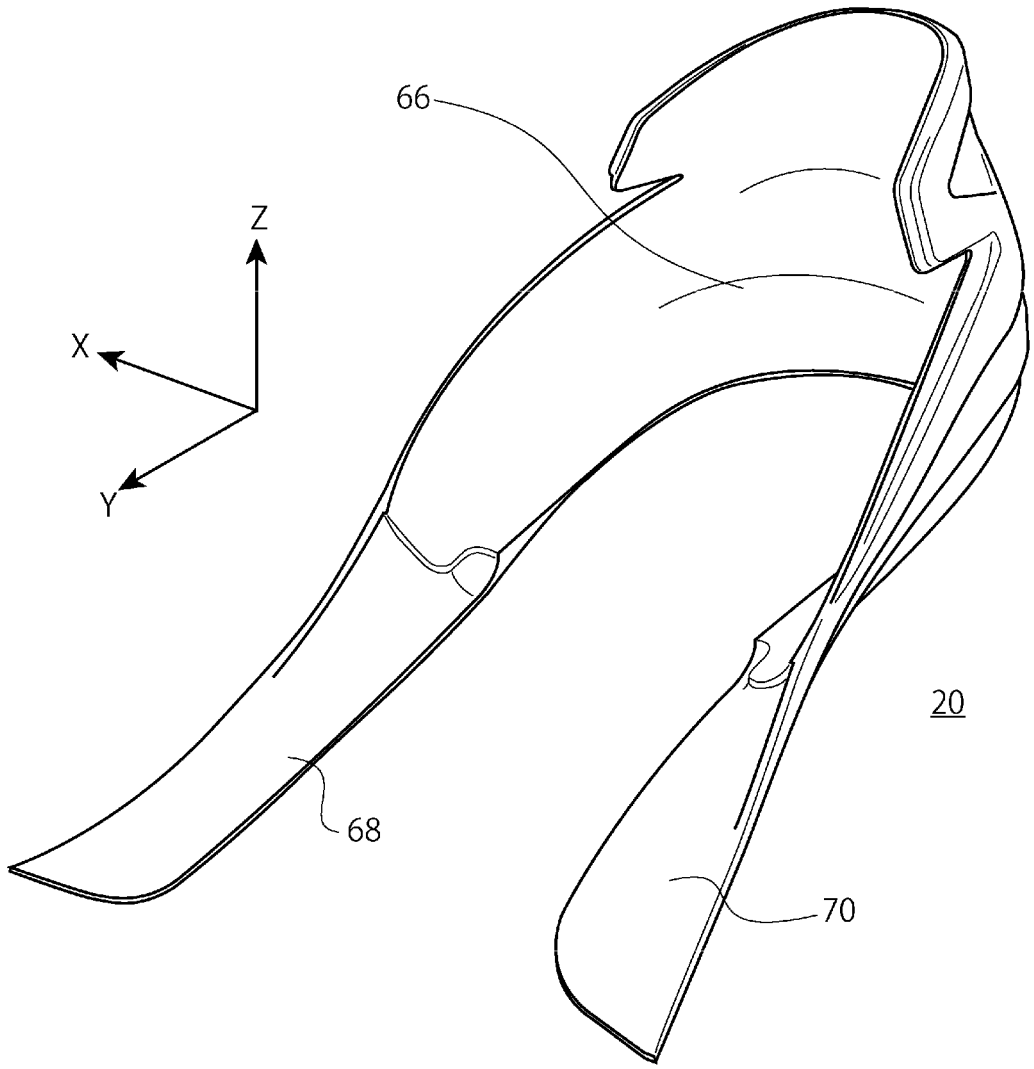
FIG. 7 is a perspective view of a reinforcement portion.
Figure 8:
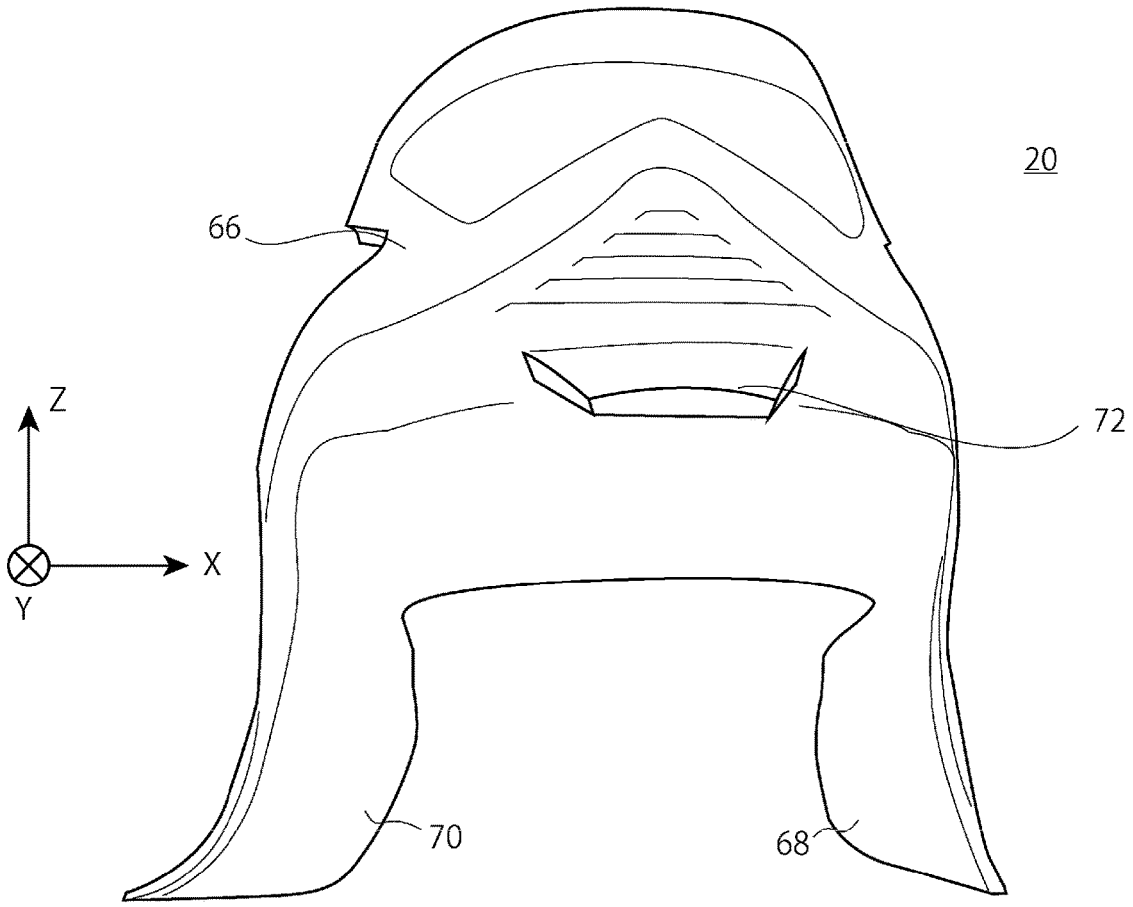
FIG. 8 is a back view of a reinforcement portion.
Figure 9:
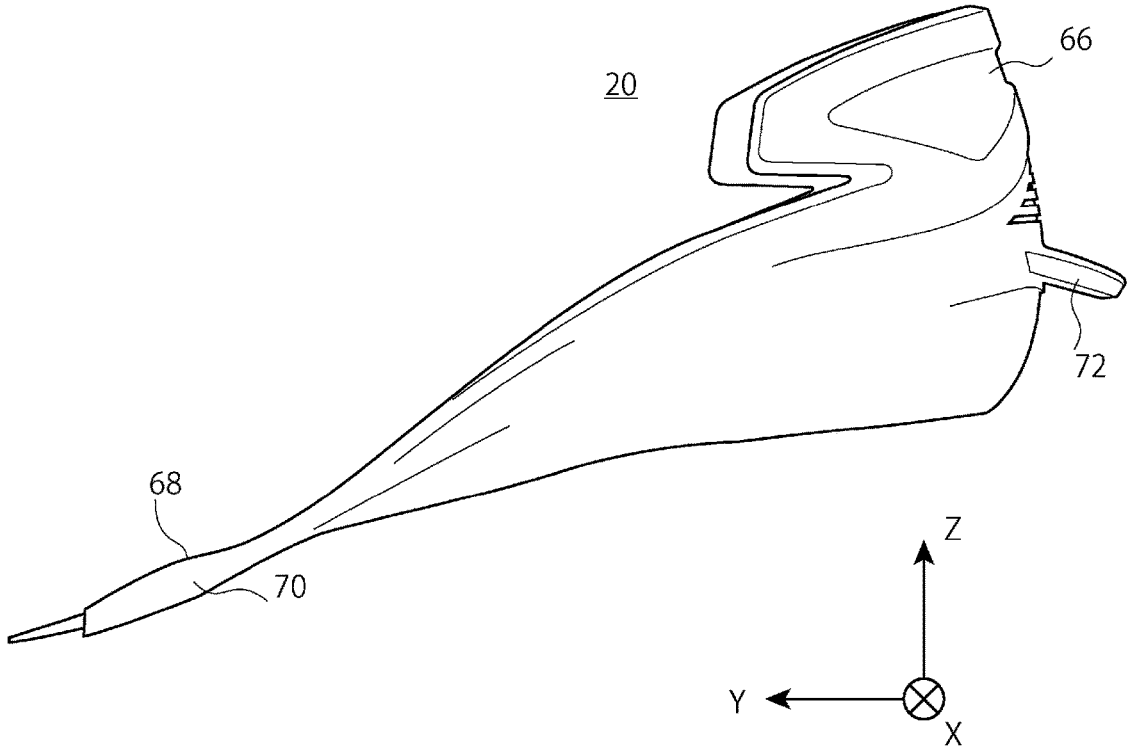
FIG. 9 is a side view of a reinforcement portion.

FIG. 7 shows a perspective view of the reinforcement member 20 FIG. 8 shows a back view of the reinforcement member 20 and FIG. 9 shows a side view of the reinforcement member 20. The reinforcement member 20 is located on the upper surface of the middle sole 14 (see FIG. 4). The reinforcement member 20 continuously extends from the rear side portion of the middle sole 14 to the vicinity of the boundary between the middle foot portion and the front foot portion. The reinforcement member 20 may be made of the same material as the elastic structure 18. The reinforcement member 20 may be made integral with the elastic structure 18. The reinforcement member 20 can improve strength of the middle sole 14 in the area between the rear foot portion and the boundary of the middle foot portion and the front foot portion and can also improve integrity. Also, twist around the center line S of the shoe 10 can be prevented.

The reinforcement member 20 comprises a heel support portion 66, an inner foot side support portion 68, an outer foot support portion 70 and a convex portion 72. The inner foot side support portion 68 and the outer foot side support portion 70 respectively extends toward the front side from both sides in the width direction of the front end of the heel support portion 66. Therefore, the reinforcement member 20, when seen from the top, has a substantially U-shape. The convex portion 72 is formed on the rear side of the heel support portion 66. Although it is not shown in the drawings, an inner sole or an insole can be provided on the reinforcement member. The reinforcement member 20 is not a mandatory configuration and may be omitted.

The heel support portion 66 surrounds both sides of the wearers heel in the width direction and the rear side of the wearers heel, when worn, and holds the wearers heel.

The inner foot side support portion 68 extend along the inner foot side from the rear end portion to the middle foot portion of the foot contacting surface 40. The inner foot side support portion 68 supports the inner foot side of the wearers foot. The outer foot side support portion 70 extend along the outer foot side from the rear end portion to the middle foot portion of the foot contacting surface 40. The outer foot side support portion 70 supports the outer foot side of the wearers foot. Space is formed between the inner foot side support portion 68 and the outer foot side support portion 70. By forming this space, relatively hard materialled reinforcement member 20 does not exist between the wearers foot and the middle sole 14 (see FIG. 4). By this, loss of cushioning characteristic can be prevented.

With reference to FIGS. 4 and 5, the inner foot side support portion 68 and the outer foot side support portion 70 enters inside the middle sole 14 at the vicinity of the boundary of the rear foot portion and the middle foot portion. Thus, the inner foot side support portion 68 and the outer foot side support portion 70 are shaped to tilt forward when seen from the side.

Returning to FIGS. 7-9, by engaging the convex portion 72 with the concave portion 62 of the elastic structure 18, the reinforcement member 20 and the elastic member 18 are connected. Connecting the elastic structure 18 and the reinforcement member 20 includes connecting the elastic member 18 and the reinforcement member 20 so that force can be transferred therebetween at least in the vertical direction. The convex portion 72 is fitted within the concave portion 62 from the upper side. A coupling mechanism such as an adhesive may be applied between the convex portion 72 and the concave portion 62. The movement of the convex portion 72 to the right or left direction is inhibited or prevented by the concave portion 62. By the engagement structure of the concave portion 62 and the convex portion 72, load applied to the reinforcement member 20 is transferred to the elastic structure 18 and when the elastic structure 18 generates repulsive force, the repulsive force is transferred to the reinforcement member 20. When the shoe 10 is worn, the weight of the wearer is applied to the reinforcement member, so in a basic condition, the convex portion 72 of the reinforcement member 20 pushes the elastic structure 18 downwards. Also, when the elastic structure 18 generates repulsive force, the concave portion 62 of the elastic structure is pushed against the convex portion 72 of the reinforcement member. Structures other than a connecting structure using concave portion 62 and convex portion 72 may be used.

Figure 10:
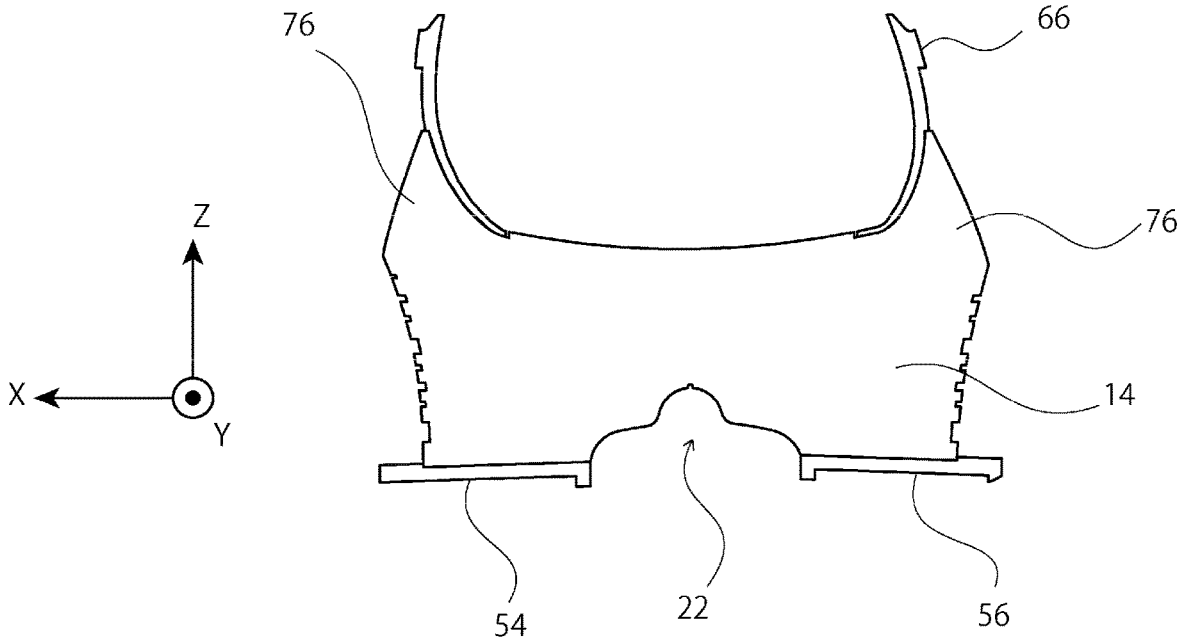
FIG. 10 is a sectional view along section BB of FIG. 4.

FIG. 10 shows a sectional view of section BB in FIG. 4. As shown in FIG. 10, lifted portions 76, 76 rising along the reinforcement member 20 are formed on the inner foot side and the outer foot side of the middle sole 14. By this, shifting of the reinforcement member in the width direction can be prevented. Although it is not shown, the middle sole 14 may comprise a lifted portion on the rear side of the reinforcement member 20.

The groove 22 is formed at the middle in the width direction of the middle sole 14 and extends from the rear foot portion to the middle foot portion. The groove 22 is located between the inner foot side portion 54 and the outer foot side portion 56 of the elastic structure 18. The inner surface of the groove 22 has a substantially tapered shape and the width thereof narrows toward the upper side. By forming the groove 22, the middle part in the width direction of the middle sole 14 becomes easier to bend and the cushioning characteristic can be improved.

The function of the shoe 10 will now be explained.

Figure 11:
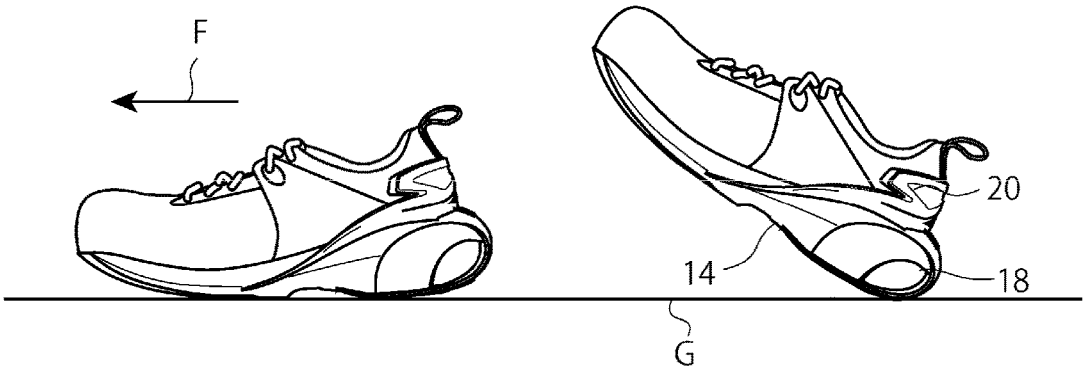
FIG. 11 is a side view of a shoe.

FIG. 11 shows a side view of the shoe. When the wearer lands wearing the shoe 10, the heel portion of the shoe 10, namely the elastic structure 18 first contacts the ground surface G. When the elastic structure 18 contacts the ground surface G, the elastic structure 18 is deformed. Since space 48 is formed on the upper side of the elastic structure 18, the deformation of the elastic structure 18 is not obstructed. When the elastic structure 18 is deformed, the elastic structure 18 generates cushioning characteristic. Since the foot contacting surface 40 is tilted, the middle portion of the wearers foot becomes substantially parallel to the ground surface G when landing.

When the elastic structure 18 is deformed at a certain amount, the elastic structure 18 starts to restore the original shape. When the elastic structure is restored at a condition where the shoe 10 has rolled forward, the restoring force of the elastic structure 18 is transferred to the reinforcement member 20 via the connecting structure. When the restoring force is transferred to the reinforcement member 20, the heel support portion 66, the inner foot side support portion 68 and the outer foot side support portion 70 pushes the sole of the foot of the wearer. As the ground contacting surface 42 transits parallel to the ground surface G, the middle foot portion tilts forward due to the tilt of the foot contacting surface 40. By this, the wearers position naturally transits to a forward tilted position. Since the reinforcement member 20 is tilted forward, the force pushing the sole of the foot applied by the reinforcement member 20 comprises a forwardly directed component F. By this, forwardly directed acceleration force is applied to the wearer.

As described above, the shoe 10 can provide acceleration force to the wearer or at least an acceleration feeling to the wearer by using the repulsion force generated by the elastic structure 18.

Further, since the inner foot side portion 54 and the outer foot side portion 56 of the elastic structure 18 are integrated with the ground contacting surface 42, the difference in appearance compared to a show without the elastic structure 18 is merely the elastic structure 18 protruding rearwards from the middle sole 14. Since the elastic structure 18 is fixed to the middle sole 14, the elastic structure 18 will not oscillate while running and discomfort can be prevented. Also, since the elastic structure 18 protrudes rearward from the middle sole 14, stability of the shoe 10 is not lost when the shoe 10 is placed on a flat surface.

The present invention is not limited to the embodiment explained above and each configuration of the embodiment may be revised without departing from the spirit of the present invention. Alternatives such as listed below are assumed to be within the scope of the present invention.

FIGS. 12-16 show schematic side views of shoes according to alternative embodiments.

Figure 12:
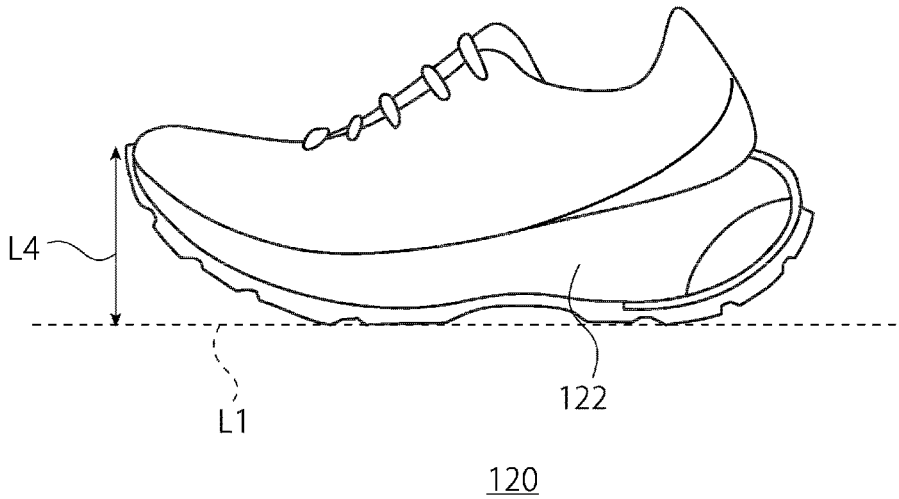
FIG. 12 is a schematic side view of a shoe according to an alternative example.

As shown in FIG. 12, a shoe 120 according to a first alternative embodiment has a front foot lifted shape where the front foot portion is lifted upwards to accelerate a rolling movement. When the shoe 120 is placed on a horizontal surface L1, the distance L4 from the horizontal surface L1 to the front end of the middle sole 122 is preferably 1.7-2.5 times the thickness of the middle sole 122 at the middle foot portion. The thickness of the middle sole 122 may be measured at a location where the ground contacting surface of the middle sole 122 contacts the horizontal surface L1, positioned rearwards from where the middle sole 122 starts to lift upwards. According to shoe 120, more acceleration force may be generated due to the combination of the elastic structure 18 and the front foot lifted shape.

Figure 13:
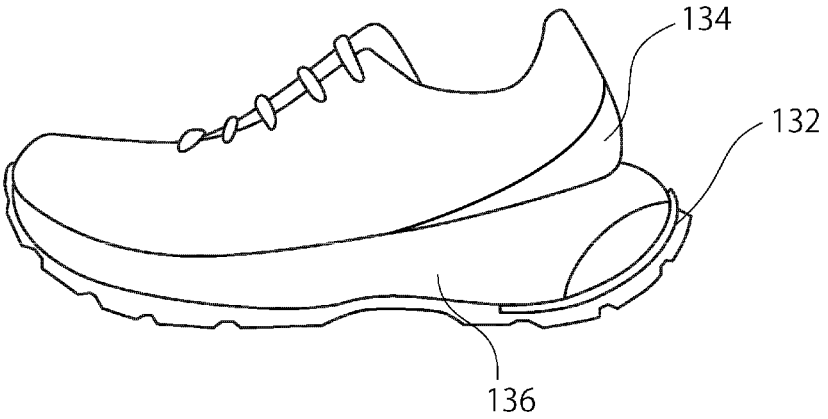
FIG. 13 is a schematic side view of a shoe according to an alternative example.

As shown in FIG. 13, with a shoe 130 according to a second alternative embodiment, an elastic structure 132 is not connected to a reinforcement member 134. Rather, the elastic structure 132 is connected to the most rear part of a middle sole 136. Certain repulsion force and cushioning characteristic may be expected even without connecting the elastic structure 132 and the reinforcement member 134.

Figure 14:
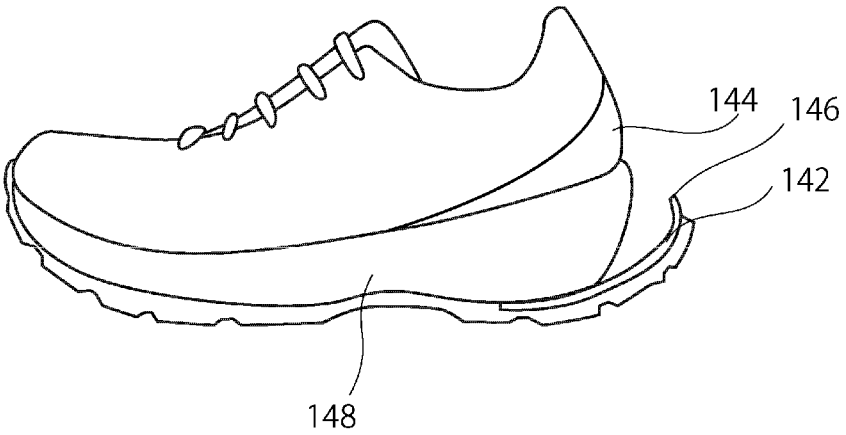
FIG. 14 is a schematic side view of a shoe according to an alternative example.

As shown in FIG. 14, with a shoe 140 according to a third alternative embodiment, the elastic structure 142 is not connected to the reinforcement member 144 and the other end 146 of the elastic structure 142 is also not connected to the middle sole 148. In other words, the rear end of the elastic structure 142 is a free end curved upwards. Certain repulsion force and cushioning characteristic may be expected with such configuration.

Figure 15:
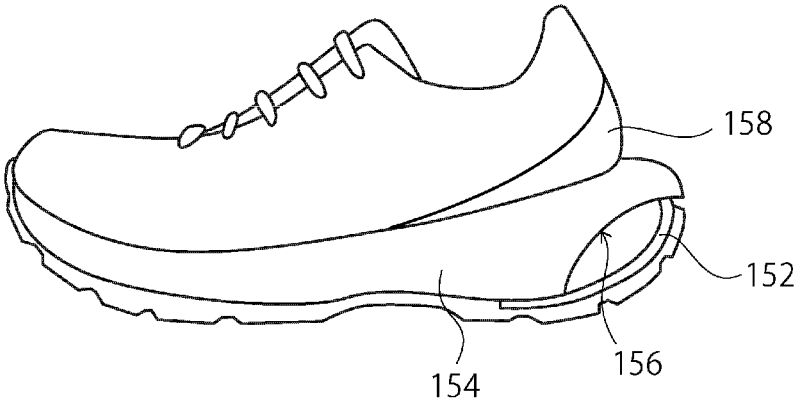
FIG. 15 is a schematic side view of a shoe according to an alternative example.

As shown in FIG. 15, with a shoe 150 according to a fourth alternative embodiment, the rear end of a elastic structure 152 is in contact with a rear end surface 156 of a middle sole 154. With such configuration, repulsion force generated by the elastic structure 152 can be transferred to a reinforcement member 158 via the middle sole 154. In such a case, the rear end portion of the middle sole 154 may be formed with material having higher stiffness than the rest of the middle sole and with such configuration, the reinforcement member 158 and the elastic structure 152 may substantially be connected by a rigid body. Certain repulsion force and cushioning characteristic may be expected by such configuration.

Figure 16:
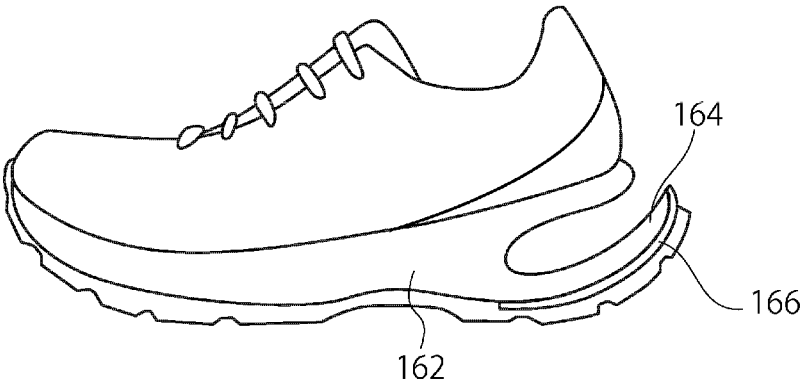
FIG. 16 is a schematic side view of a shoe according to an alternative example.

As shown in FIG. 16, with a shoe 160 according to a fifth alternative embodiment, a middle sole 162 is vertically separated at the rear foot portion. At the bottom of a lower portion 164 of the middle sole 162, an elastic structure 166 is located. Certain repulsion force and cushioning characteristic may be expected by such configuration.

As explained in connection with various embodiments above, certain repulsion force and cushioning characteristic may be expected if an elastic structure extending rearwards from the ground contacting surface of the middle sole is provided. In such a case, it is only necessary to provide the elastic structure at least on the outer foot side where it first contacts the ground while landing in most situations.

DESCRIPTION OF THE REFERENCE NUMERALS

10: Shoe
12: Upper
14: Middle sole
18 Elastic structure
22: Groove
40: Foot contacting surface
42: Ground contacting surface
44: Rear end surface
46: Inner side surface
48: Space
54: Inner foot side portion
56: Outer foot side portion
66: Heel support portion
68: Inner foot side support portion
70: Outer foot side support portion

What is claimed:

1. A shoe comprising:

a sole including a foot contacting surface and a ground contacting surface;

an upper at least partially covering the foot contacting surface of the sole;

an elastic structure coupled to the sole and including a bottom portion including a forked shape defined by an inner foot side portion and an outer foot side portion each extending in a forward direction from a lower central portion of the elastic structure, with a space between the inner foot side portion and the outer foot side portion, wherein the inner foot side portion and the outer foot side portion are connected to one another at a single location at a rear side of a rear end of the ground contacting surface; and the elastic structure including an upper portion including a first protrusion extending forwardly from an upper central portion of the elastic structure toward an inner foot side of the shoe and a second protrusion extending forwardly from the upper central portion of the elastic structure toward an outer foot side of the shoe.

2. The shoe according to claim 1, wherein the elastic structure, when viewed from a side, includes a substantially U-shaped form protruding rearwards.

3. The shoe according to claim 1, wherein the elastic structure includes a substantially U-shaped form when viewed from above.

4. The shoe according to claim 1, wherein an inner surface of the elastic structure opposes a rear end surface of the sole with a distance therebetween.

5. The shoe according to claim 4, wherein the rear end surface of the sole, viewed from a side, has a forwardly curved shape downward, and a space penetrating in a width direction is formed between the rear end surface of the sole and the inner surface of the elastic structure.

6. The shoe according to claim 1, wherein a front end of the inner foot side portion is located more forward than a front end of the outer foot side portion.

7. The shoe according to claim 1, wherein a groove is formed in the sole between the inner foot side portion and the outer foot side portion.

8. The shoe of claim 7, including a toe side and a heel side, the shoe also including a front foot portion extending from 0 to 30 percent of an entire length of the shoe measured from the toe side to the heel side, a middle foot portion extending from 30 to 80 percent of the entire length of the shoe measured from the toe side to the heel side, and a rear foot portion extending from 80 to 100 percent of the entire length of the shoe measured from the toe side to the heel side, wherein the toe side is equivalent to 0 percent of the entire length of the shoe and the heel side is equivalent to 100 percent of the entire length of the shoe, and wherein the groove extends from the rear foot portion to the middle foot portion of the shoe.

9. The shoe according to claim 1, wherein a heel support portion is located on the foot contacting surface for supporting a wearer's heel when wearing the shoe, wherein the heel support portion is connected to the elastic structure.

10. The shoe according to claim 9, wherein the heel support portion is connected to the elastic structure so that force can be transferred in a vertical direction.

11. The shoe according to claim 9, further comprising an inner foot side support portion connected to the heel support portion and extending along an inner foot side at least from a rear foot portion to a middle foot portion; and an outer foot side support portion connected to the heel support portion and extending along the outer foot side at least from the rear foot portion to the middle foot portion.

12. The shoe according to claim 1, wherein a front foot portion of the sole is tilted upwards and when the shoe is placed on a flat imaginary surface, a distance between a front end of the sole and the flat imaginary surface is 1.7-2.5 times a thickness of the sole at a middle foot portion.

13. A shoe comprising:

a sole; sole including a foot contacting surface and a ground contacting surface;

an upper at least partially covering the sole;

an elastic structure comprising a plate including a lower portion including a forked shape defined by an inner foot side portion and an outer foot side portion each extending below a portion of the sole and toward a front of the shoe from a lower central portion of the plate, with a space between the inner foot side portion and the outer foot side portion, wherein the inner foot side portion and the outer foot side portion are connected to one another at a single location at a rear side of a rear end of the ground contacting surface; and the plate further including an upper portion including a first protrusion extending forwardly from an upper central portion of the plate toward an inner foot side of the shoe and a second protrusion extending forwardly from the upper central portion of the plate toward an outer foot side of the shoe.

14. The shoe of claim 13, wherein the sole includes a groove in a bottom surface thereof, wherein the groove is exposed in the space between the inner foot side portion and the outer foot side portion.

15. The shoe of claim 14, including a toe side and a heel side, the shoe also including a front foot portion extending from 0 to 30 percent of an entire length of the shoe measured from the toe side to the heel side, a middle foot portion extending from 30 to 80 percent of the entire length of the shoe measured from the toe side to the heel side, and a rear foot portion extending from 80 to 100 percent of the entire length of the shoe measured from the toe side to the heel side, wherein the toe side is equivalent to 0 percent of the entire length of the shoe and the heel side is equivalent to 100 percent of the entire length of the shoe, and wherein the groove extends from the rear foot portion to the middle foot portion of the shoe.

16. The shoe according to claim 13, wherein the elastic structure includes a substantially U-shaped form when viewed from above.

17. The shoe according to claim 13, wherein an inner surface of the plate opposes a rear end surface of the sole with a distance therebetween.

18. The shoe according to claim 17, wherein the rear end surface of the sole, viewed from a side, has a forwardly curved shape downward, and a space penetrating in a width direction is formed between the rear end surface of the sole and the inner surface of the plate.

19. The shoe of claim 13, including a toe side and a heel side, the shoe also including a front foot portion extending from 0 to 30 percent of an entire length of the shoe measured from the toe side to the heel side, a middle foot portion extending from 30 to 80 percent of the entire length of the shoe measured from the toe side to the heel side, and a rear foot portion extending from 80 to 100 percent of the entire length of the shoe measured from the toe side to the heel side, wherein the toe side is equivalent to 0 percent of the entire length of the shoe and the heel side is equivalent to 100 percent of the entire length of the shoe, and wherein the lower central portion of the plate and the upper central portion of the plate are positioned in the rear foot portion of the shoe.

20. The shoe according to claim 13, wherein a front foot portion of the sole is tilted upwards and when the shoe is placed on a flat imaginary surface, a distance between a front end of the sole and the flat imaginary surface is 1.7-2.5 times a thickness of the sole at a middle foot portion.

* * * * *